US009630032B2

(12) United States Patent
Unger et al.

(10) Patent No.: US 9,630,032 B2
(45) Date of Patent: Apr. 25, 2017

(54) PRESSURIZED GAS CYLINDER HOLDER FOR A RESPIRATOR

(71) Applicant: Dräger Safety AG & Co., KGaA, Lübeck (DE)

(72) Inventors: Jürgen Unger, Berlin (DE); Axel Bahr, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 872 days.

(21) Appl. No.: 13/916,971

(22) Filed: Jun. 13, 2013

(65) Prior Publication Data

US 2014/0076316 A1 Mar. 20, 2014

(30) Foreign Application Priority Data

Sep. 19, 2012 (DE) ..... 10 2012 018 541

(51) Int. Cl.

| | |
|---|---|
| ***A62B 7/00*** | (2006.01) |
| ***A62B 9/00*** | (2006.01) |
| ***A62B 25/00*** | (2006.01) |
| ***F17C 13/08*** | (2006.01) |

(52) U.S. Cl.

CPC ..... *A62B 25/005* (2013.01); *A62B 7/00* (2013.01); *F17C 13/084* (2013.01); *A62B 9/00* (2013.01); *Y10T 29/49826* (2015.01)

(58) Field of Classification Search

CPC ..... F17C 13/084; B63C 11/02; B63C 11/22; B63C 2011/024; B63C 2011/025; B63C 2011/026; B63C 2011/027; A62B 25/00; A62B 9/04

USPC ..... 248/313, 311.2; 206/446; 211/85.13, 211/71.01, 85.18, 85.22; 220/646, 647, 220/648, 650

See application file for complete search history.

(56) References Cited

U.S. PATENT DOCUMENTS

| | | | | |
|---|---|---|---|---|
| 3,191,828 A * | 6/1965 | Senne | ..... | A62B 9/04 224/604 |
| 3,392,682 A * | 7/1968 | Francis | ..... | B61D 45/003 105/422 |
| 4,391,377 A * | 7/1983 | Ziaylek, Jr. | ..... | A47B 81/007 206/443 |

(Continued)

FOREIGN PATENT DOCUMENTS

| | | |
|---|---|---|
| CN | 2565465 Y | 8/2003 |
| CN | 2838674 Y | 11/2006 |

(Continued)

*Primary Examiner* — Valerie L Woodward
*Assistant Examiner* — Douglas Sul
(74) *Attorney, Agent, or Firm* — McGlew and Tuttle, P.C.

(57) ABSTRACT

A pressurized gas cylinder holder for a respirator includes a holding part (15) and at least one tightening strap for fastening a pressurized gas cylinder to a holding part (15). Pressurized gas cylinders with different external diameters are able to be fastened to the pressurized gas cylinder holder with an identical longitudinal axis. The holding part (15) has at least two support elements (19) as separate components in addition to the rest of the holding part (15) for supporting the pressurized gas cylinder and at least four fixing devices (20) formed on the holding part (15) for the at least two support elements (19). The support elements (19) may be fastened to different fixing devices (20) for adaptation to pressurized gas cylinders (9) with a different external diameter.

20 Claims, 9 Drawing Sheets

(56) References Cited

U.S. PATENT DOCUMENTS

| | | | | |
|---|---|---|---|---|
| 5,100,007 | A | 3/1992 | Espasandin et al. | |
| 5,474,269 | A * | 12/1995 | Kasubke | F16L 3/137 248/230.9 |
| 5,533,701 | A | 7/1996 | Trank | |
| 7,434,766 | B2 | 10/2008 | Pozzi et al. | |
| 8,083,003 | B2 | 12/2011 | Felten et al. | |
| 8,398,040 | B2 | 3/2013 | Busch | |
| 2007/0063469 | A1* | 3/2007 | Blum | B62B 1/264 280/47.26 |
| 2008/0173307 | A1* | 7/2008 | Carron | A62B 9/04 128/205.22 |
| 2010/0219220 | A1* | 9/2010 | Bostrom | A62B 9/04 224/547 |
| 2010/0282793 | A1* | 11/2010 | Wrigley | A45F 3/14 224/246 |
| 2010/0313394 | A1* | 12/2010 | Busch | A62B 9/04 24/68 C |

FOREIGN PATENT DOCUMENTS

| | | | |
|---|---|---|---|
| CN | 200963463 | Y | 10/2007 |
| CN | 201093170 | Y | 7/2008 |
| DE | 729 555 | C | 12/1942 |
| DE | 297 04 328 | U1 | 5/1997 |
| DE | 10 2009 024 674 | B3 | 8/2010 |
| EP | 1839926 | A1 | 10/2007 |
| RU | 2008131499 | A | 2/2010 |
| RU | 2385826 | C2 | 4/2010 |
| RU | 2407570 | C2 | 12/2010 |
| SU | 1544622 | A1 | 2/1990 |
| WO | 01/91857 | A1 | 12/2001 |

* cited by examiner

PRESSURIZED GAS CYLINDER HOLDER FOR A RESPIRATOR

CROSS REFERENCE TO RELATED APPLICATIONS

This application claims the benefit of priority under 35 U.S.C. §119 of German Patent Application DE 10 2012 018 541.3 filed Sep. 19, 2012, the entire contents of which are incorporated herein by reference.

FIELD OF THE INVENTION

The present invention pertains to a pressurized gas cylinder holder with a gas cylinder holding part at least one tightening strap for fastening a pressurized gas cylinder to the holding part, to a respirator with a pressurized gas cylinder, a pressurized gas cylinder holder for fastening the pressurized gas cylinder, a pressure reducer, a carrying tray and a breathing mask and to a method for fastening a pressurized gas cylinder to a pressurized gas cylinder holder.

BACKGROUND OF THE INVENTION

Respirators are used to enable the user of the respirator to spend a long time in an environment in which the air contains toxic substances. Respirators are used with and without a closed breathing air circuit. If the respirator has a closed breathing air circuit, $CO_2$ is removed from the expired air and oxygen is added from a pressurized gas cylinder acting as an oxygen cylinder. The oxygen reserve of the oxygen cylinder is, for example, under a pressure of 300 bar in this case. The respirator has a carrying tray, to which the components of the respirator are fastened. Due to the high pressure of the oxygen in the oxygen cylinder, a pressure reducer is necessary. The oxygen cylinder, which has a circular cross section, is fastened as a container wall to the respirator with a pressurized gas cylinder holder.

The pressurized gas cylinder holder has a holding part made of plastic and at least one tightening strap for fastening the pressurized gas cylinder. The holding part has a partly arc-shaped cross section and the pressurized gas cylinder is placed on this part of the holding part and then fastened with a tightening strap. It may in this case be necessary to fasten oxygen cylinders with a different external diameter to the pressurized gas cylinder holder. The pressurized gas cylinder has a longitudinal axis and if the external diameter of the pressurized gas cylinder is different, this causes the centric longitudinal axis of the pressurized gas cylinder not to be aligned correspondingly any longer with the pressure reducer or with a 90° pressurized gas elbow in case of an external diameter that is greater than the external diameter for which the holding part is designed. As a result, the pressurized gas cylinder cannot be connected any longer to the respirator or to the pressurized gas cylinder holder of the respirator, because the ports on the pressurized gas cylinder for removing oxygen are no longer aligned with the ports of the pressure reducer.

DE 729 555 A shows a holder for pressurized gas cylinders with a tightening strap, which is fastened to the support body of the pressurized gas cylinder, is led around the body of the cylinder and is held together with a manual closing device, wherein the securing means, which hold the tightening strap at the support body of the pressurized gas cylinder, and the closing parts, which connect the two tightening halves to one another, are hung themselves detachably into holding means, especially recesses of the tightening strap, which occur repeatedly in the longitudinal direction of the tightening strap.

WO 01/91857 A1 shows a cylinder support for pressurized gas cylinders, against which one or more pressurized gas cylinders are pressed by means of a tightening strap after establishing the connections between the high-pressure connecting branch and the pressure reducer. The cylinder support has sliding inserts, which protrude from the surface of the cylinder support in the direction of each pressurized gas cylinder, so that each filled pressurized gas cylinder is mounted on them in the unbraced state and can be slidingly moved, and the sliding inserts can be recessed into the cylinder support under the action of the force of the tightening strap on the pressurized gas cylinder and hence at the same time under the action of the force acting on the sliding inserts.

SUMMARY OF THE INVENTION

An object of the present invention is therefore to make available a pressurized gas cylinder holder, a respirator and a method for fastening a pressurized gas cylinder, in which pressurized gas cylinders with a different external diameter can be fastened to the pressurized gas cylinder holder with identical longitudinal axis in a simple manner, at low cost and reliably.

This object is accomplished with a pressurized gas cylinder holder for a respirator, comprising a holding part, and at least one tightening strap for fastening a pressurized gas cylinder to the holding part. The pressurized gas cylinder holder has at least two support elements as separate components, in addition to the rest of the holding part, for supporting the pressurized gas cylinder and at least four fixing devices formed on the holding part for the at least two support elements. The at least two support elements are each fastened to a fixing device, so that the at least two support elements can be fastened at different fixing devices for adaptation to pressurized gas cylinders with a different external diameter. The pressurized gas cylinder lies on the support elements, and based on the possibility of fastening the support at different positions, pressurized gas cylinders with different external diameters can be fastened as a result such that the pressurized gas cylinders with the different external diameter have an identical centric longitudinal axis in relation to the holding part. This is possible due to the fact that an identical centric longitudinal axis is associated with the holding part for the pressurized gas cylinders with the different diameter and the support elements are fastened at a different distance or radial distance in relation to said longitudinal axis in the different positions, so that pressurized gas cylinders with a different external diameter can be fastened as a result at the pressurized gas cylinder holder with an identical centric longitudinal axis.

The holding part is designed, in particular, as a holding frame, a holding plate or a frame with longitudinal and cross struts and/or the holding part has support components with an essentially arc-shaped cross section, and at least one first support component has a greater radius of curvature than at least one second support component, and both support components are aligned essentially concentrically with one another. The pressurized gas cylinder lies on the support elements and the at least one tightening strap. The support elements make possible a punctiform mounting at the holding part only, so that preferably at least three support elements at the holding part are designed as part of the holding part. The support components are preferably elastic, so that the pressurized gas cylinder can lie, especially for a short time only, on the arc-shaped components of the holding part in case of a great elastic deformation of the support elements. The arc-shaped support components are used as a result for the additional positive-locking holding of the pressurized gas cylinder at the pressurized gas cylinder holder.

In another embodiment, the at least two fixing devices are designed as recesses, especially openings, or as Velcro fasteners at the holding part, and/or the at least two support elements are fastened with the fixing devices such that if the at least one tightening strap is tightened on the pressurized gas cylinder, which lies on the at least two support elements, the at least two support elements cannot be moved or recessed, and, in particular, an elastic deformation of the at least two support elements is not taken into consideration. Recesses can be prepared on the holding part in an especially simple manner and at a low cost during the injection molding from thermoplastics.

In an additional embodiment, the at least two support elements are fastened to the holding part in a positive-locking and/or non-positive manner, especially with a locking or plug-type connection. Besides a locking or plug-type connection, the connection may advantageously also be a rotary plug-type connection between the support elements and the rest of the holding part.

The pressurized gas cylinder holder preferably comprises at least four support elements and at least eight fixing devices. The number of fixing devices is advantageously twice the number of support elements, so that all support elements can be fastened in different positions or fixing devices.

In one variant, the support elements have a greater distance from a fictitious identical centric longitudinal axis of the pressurized gas cylinders with different external diameter in case of fastening to first fixing devices than in case of fastening to second fixing devices, and the first fixing devices are preferably arranged at the at least one first support component and the second fixing devices are arranged at the at least one second support component.

The holding part advantageously consists of plastic, especially a thermoplastic, and/or the holding part is made of one piece without the at least two support elements and/or the support elements are made of plastic, preferably an elastic plastic, e.g., rubber, and/or the pressurized gas cylinder holder has at least one fixing device for fixing the at least one tightening strap in different positions. The support elements are preferably made of an elastic plastic, e.g., rubber, so that the support elements undergo elastic deformation when the pressurized gas cylinder is placed on and the tightening strap is tightened. Based on the elastic properties of the support elements, vibrations can be absorbed by the elastic support elements, so that vibrations and shocks can be reduced as a result by the support elements, which thus also act as vibration absorbing elements. A fixing device is advantageously associated with each tightening strap, and the tightening strap can be tightened correspondingly with the fixing device in different positions for different pressurized gas cylinders with a different external diameter. In general, one end of the at least one tightening strap is permanently connected to the pressurized gas cylinder holder or the rest of the respirator, and another end can be fastened to the fixing device in different positions.

According to a further aspect of the invention, a respirator is provided comprising a pressurized gas cylinder, a pressurized gas cylinder holder for fastening the pressurized gas cylinder, a pressure reducer, a carrying tray, and a breathing mask, wherein the pressurized gas cylinder holder is designed as a pressurized gas cylinder holder as described herein.

In another embodiment, the respirator comprises a $CO_2$ absorber and/or a breathing air cooler and/or a breathing bag and/or at least one breathing tube, especially an inspiration tube and expiration tube, and/or an oxygen cylinder as a pressurized gas cylinder.

The method according to the present invention for fastening a pressurized gas cylinder to a pressurized gas cylinder holder, especially to a pressurized gas cylinder holder as described herein is provided including the steps of: placing a pressurized gas cylinder on a holding part of the pressurized gas cylinder holder, placing at least one tightening strap on the pressurized gas cylinder and tightening and fastening the at least one tightening strap, so that the pressurized gas cylinder is fastened between the tightening strap and the holding part. The pressurized gas cylinder is placed on support elements on the holding part of the pressurized gas cylinder holder. The support elements are fastened at different positions on the holding part, before the pressurized gas cylinder is placed on the support elements, for adaptation to different external diameters of the pressurized gas cylinder, so that pressurized gas cylinders with a different external diameter are fastened to the pressurized gas cylinder holder with an essentially identical centric longitudinal axis.

In particular, the pressurized gas cylinders are placed on the holding part exclusively onto the support elements and they preferably lie especially exclusively on the support elements even after tightening the at least one tightening strap, and/or the support elements for a pressurized gas cylinder with a greater external diameter are fastened to the holding part at a greater distance from the identical centric longitudinal axis of the pressurized gas cylinder than in case of pressurized gas cylinders with a smaller external diameter, and the difference of the distances of the support elements for the larger pressurized gas cylinder and the smaller pressurized gas cylinder from the identical centric longitudinal axis essentially corresponds to half the difference between the external diameter of the larger pressurized gas cylinder and the external diameter of the smaller pressurized gas cylinder.

In another embodiment, the support elements are fastened to recesses, especially openings, on the holding part in a positive-locking and/or non-positive manner. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF FIG. 2

Figure 2:
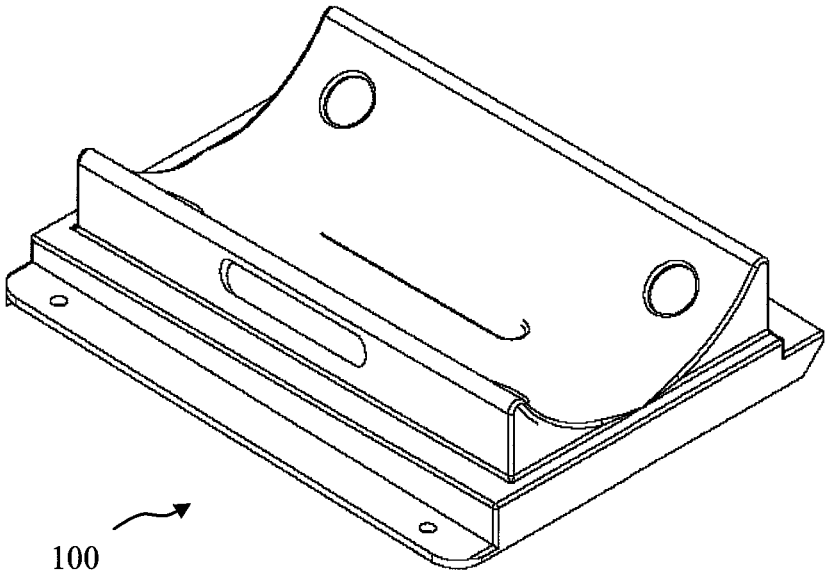
FIG. 2 is a perspective view of a holding part known from the state of the art for a pressurized gas cylinder of the respirator.
Figure 3:
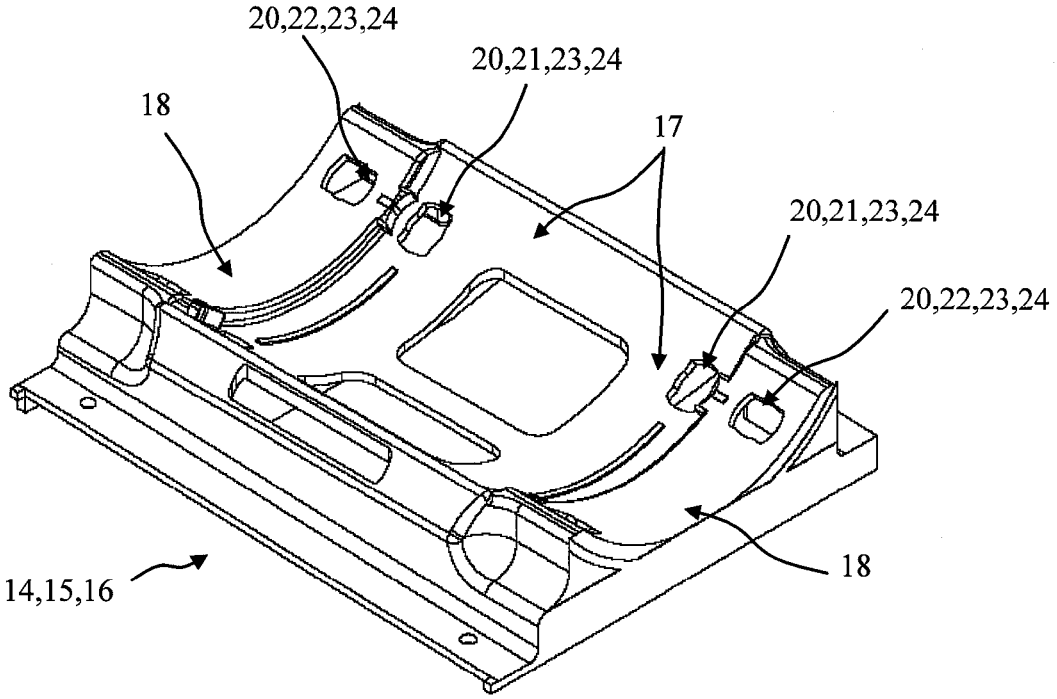
FIG. 3 is a perspective view of a holding part without support elements for a pressurized gas cylinder of a pressurized gas cylinder holder according to the present invention.
Figure 4:
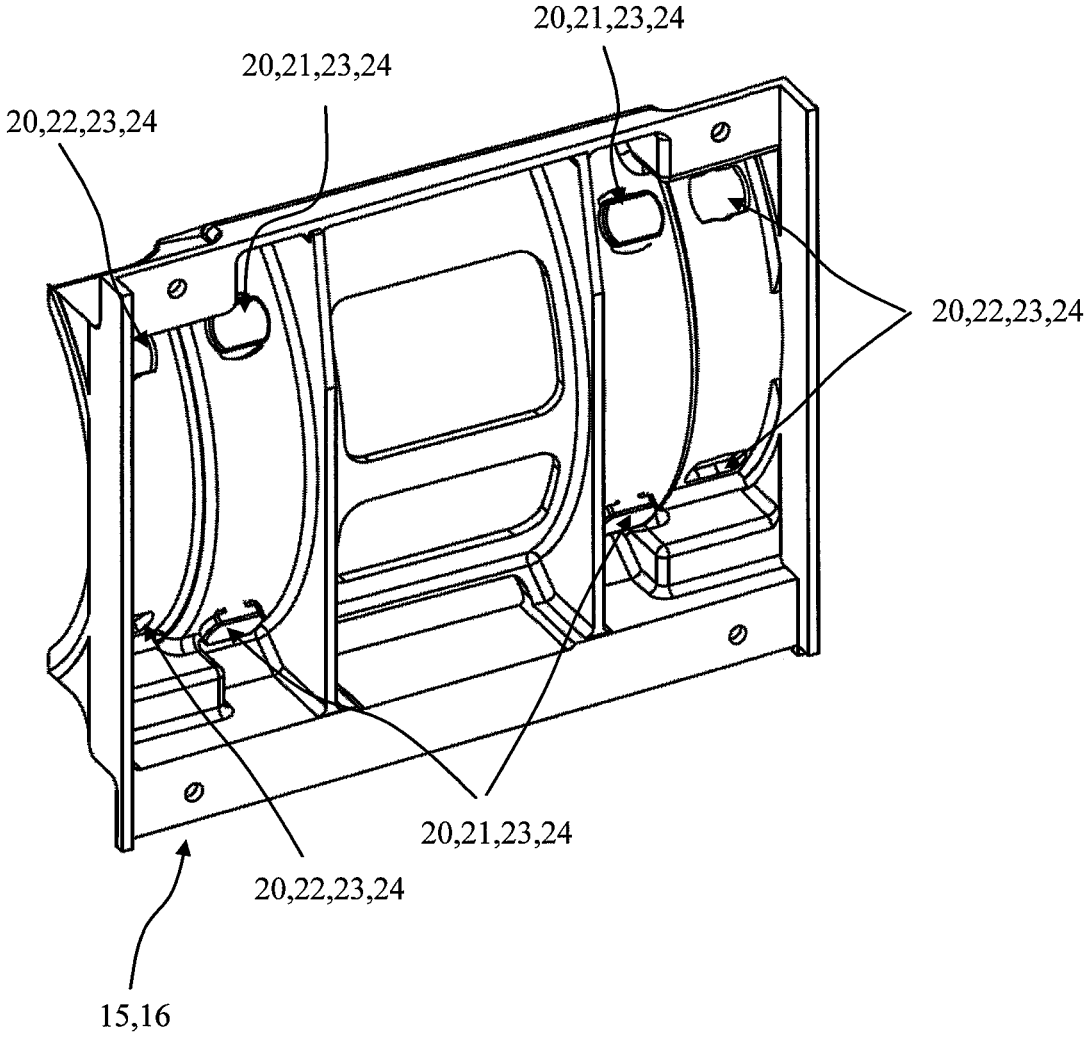
FIG. 4 is a perspective bottom view of the holding part according to FIG. 3.

FIG. 2 shows a holding part 100, consisting of a thermoplastic, which is known from the state of the art. Holding part 100 according to FIG. 2 from the state of the art has a part having a arc-shaped cross section for supporting a pressurized gas cylinder. It may be necessary to fasten pressurized gas cylinders with a different external diameter, e.g., a pressurized gas cylinder made of steel with an external diameter of 100 mm and a pressurized gas cylinder made of plastic, e.g., from CFC, with an external diameter of 110 mm, to a respirator with the pressurized gas cylinder holder 100. The pressurized gas cylinders have a circular cross section. A pressure reducer or a port for the pressure reducer is connected to the rest of the respirator in an unchanged position. When fastening pressurized gas cylinders with a different external diameter to the holding part 100 shown in FIG. 2, the centric longitudinal axes of the different pressurized gas cylinders have a different position in relation to the pressure reducer or a port of the pressure reducer. As a result, these pressurized gas cylinders with the different external diameter cannot be connected reliably in a gastight manner to the pressure reducer or they can only be connected with a corresponding effort, because this is carried out, in general, with a screw connection.

DESCRIPTION OF THE PREFERRED EMBODIMENTS

Figure 1:
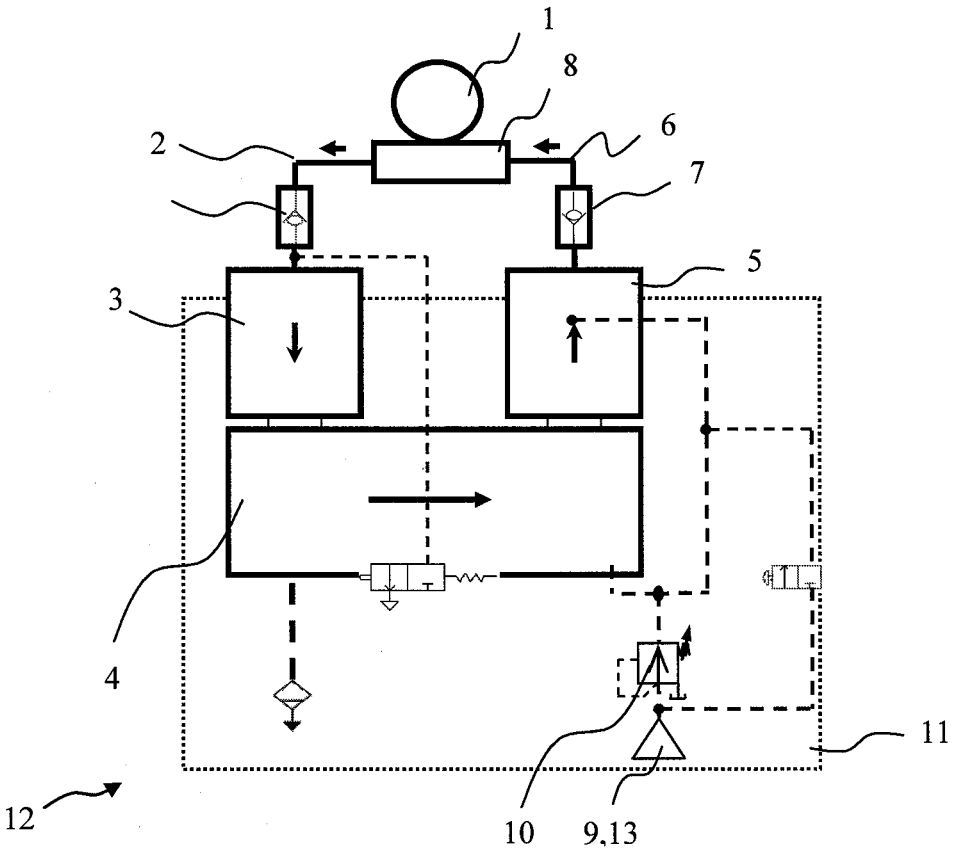
FIG. 1 is a flow diagram and operational diagram of a respirator according to the present invention.
Figure 9:
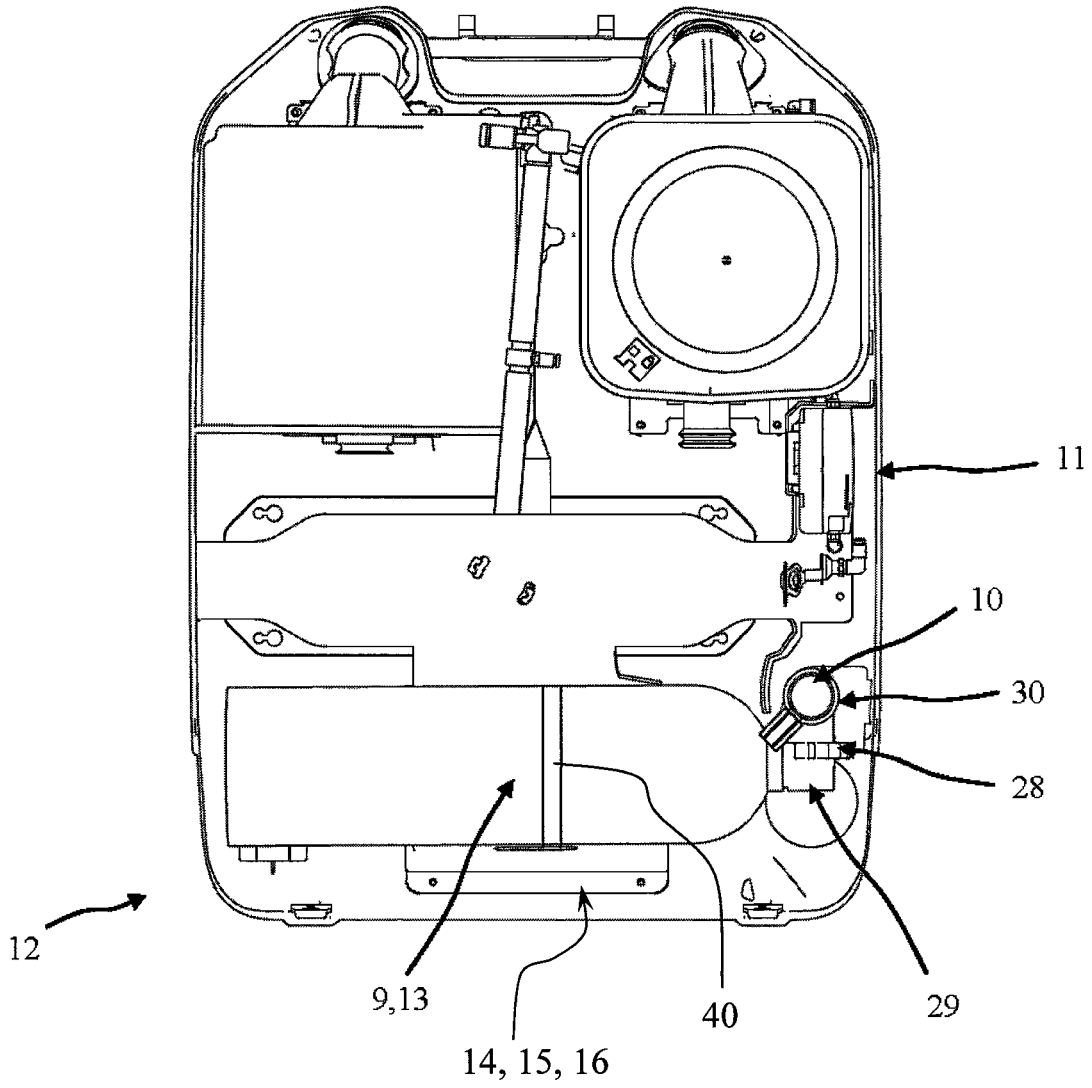
FIG. 9 is a view showing the respirator with the pressurized gas cylinder.

Referring to the drawings in particular, FIG. 1 shows a flow diagram and operational diagram of a respirator 12 according to the invention, and FIG. 9 shows a partial view of respirator 12 according to the invention. The respirator 12 comprises a breathing mask 1 to be placed on an area of the face of a user of the respirator 12 as well as an expiration tube 2 and an inspiration tube 6, with directional valves 7 each (FIG. 1). Further, respirator 12 has a breathing bag 4, a $CO_2$ absorber 3, a breathing air cooler 5, a port 8 for the breathing mask 1, a pressurized gas cylinder 9 as an oxygen cylinder 13, a pressure reducer 10 and a carrying tray 11. The pressure reducer 10 or a port for the pressure reducer is connected to the rest of the respirator 12 in a fixed position. The pressurized gas cylinder 9 is fastened to the respirator 12 with a pressurized gas cylinder holder 14. Carrying tray 11, e.g., a frame structure or plate structure made of plastic or metal, is used to fasten components, e.g., the $CO_2$ absorber 3, the breathing air cooler 5 and the pressurized gas cylinder holder 14, of the respirator 12. Thus, this is a respirator 12 with a closed breathing circuit, and the air expired by the user is freed from $CO_2$ or its $CO_2$ content is reduced in the $CO_2$ absorber, and a sufficient quantity of oxygen is fed again to the air to be inspired in the form of oxygen from the oxygen cylinder 13. The breathing air cooler 5 is necessary to remove the heat generated during the reduction of the $CO_2$ in the $CO_2$ absorber and to cool thereby the air to be inspired to a physiologically tolerable level. The oxygen in the oxygen cylinder 13 is in this case under a pressure of up to 300 bar and fed as a result to the rest of the respirator 12 or the closed breathing air circuit with a pressure reducer 10 before inspiration.

The pressurized gas cylinder holder 14 comprises a holding part 15 as a holding frame 16 and two tightening straps 40.

Figure 5:
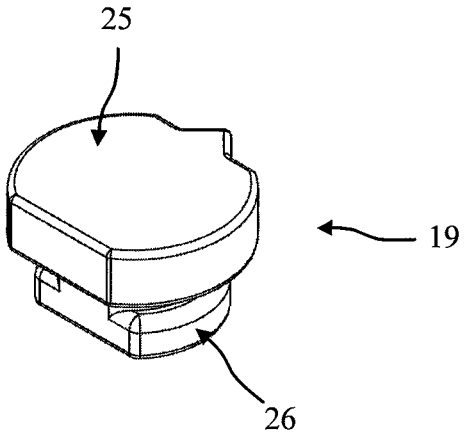
FIG. 5 is a perspective view of a support element for the holding part according to FIG. 3.

FIGS. 3, 4, 6 and 7 show the holding part 15 for the respirator 12 according to the present invention and for the pressurized gas cylinder holder 14 according to the present invention. The holding part 15 is manufactured in a simple manner and at low cost by means of injection molding from a thermoplastic. The holding part 15, FIG. 3, has centrally a first support component 17 and, on the outer side, a second support component 18. The second support component 18 is thus formed on both sides of the first support component 17 and the radius of curvature of the first support component 17 is greater than the radius of curvature of the second support component 18 in case of a concave, especially arc-shaped surface of the first and second support components 17, 18. The central first support component 18 is designed with a height offset in relation to the second support component 18, i.e., the first support component 17 is formed deeper than the second support component 18 according to the views in FIGS. 3, 6 and 7. Four openings 24 each are formed as recesses 23 on the first and second support components 17, 18. To fasten the pressurized gas cylinder 9 to the holding part 15, said pressurized gas cylinder is not placed directly on the holding part 15 made of a thermoplastic, but indirectly with support elements 19, which are part of the holding part 15. The support elements 19 are shown in FIG. 5 in a perspective view and have a support head 25 and a locking pipe 26. The support components 19 can be fastened now with the locking pipes 26 in the recesses 23 in a positive-locking and non-positive manner, especially with a rotary plug-type connection, so that the support head 25 lies on the support components 17 or 18 in the area of the openings 24 after insertion of the locking pipe 26 into the corresponding recesses 23 and the support elements 19 cannot thus be recessed or moved in relation to the holding part 15. Support head 25 has a larger diameter than the openings 24.

Figure 6:
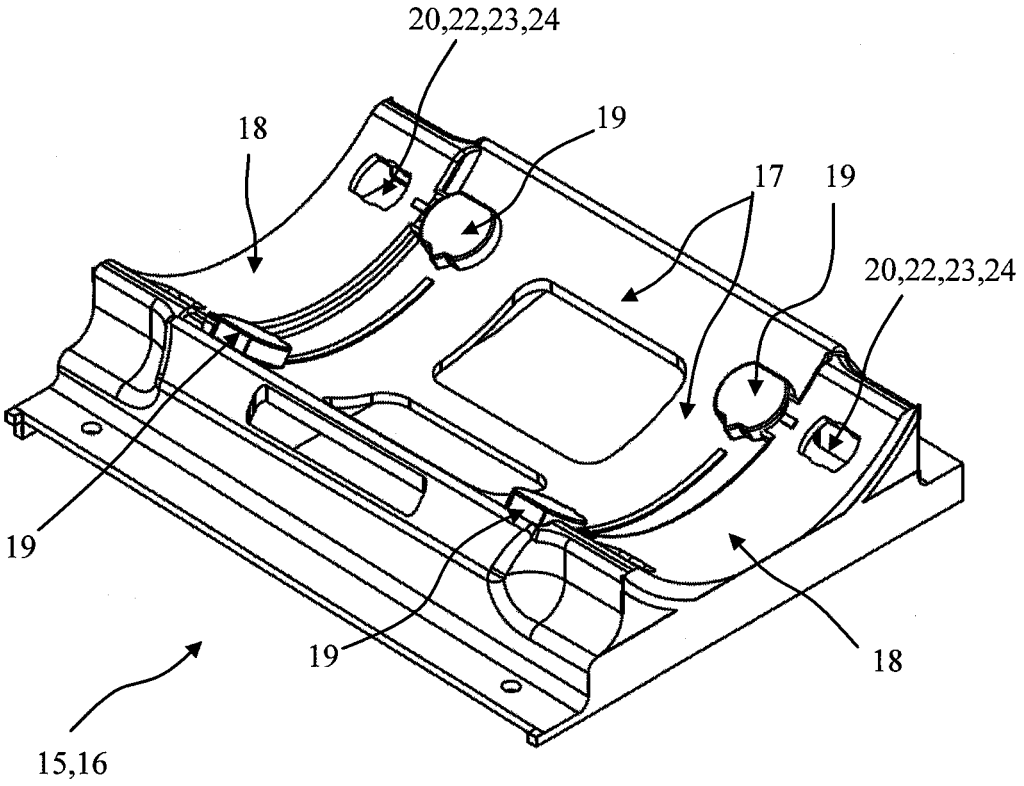
FIG. 6 is a perspective view of the holding part according to FIG. 3 with support elements in a first support position at first fixing devices.

All four support elements 19 are fastened to the four recesses 123 as fixing devices 20 at the first support component in FIG. 6, The recesses 23 on the first support component 17 thus form first fixing devices 21 for the support elements 19. Four openings 24 or recesses 23 are analogously formed as second fixing devices 22 at the holding part 15 at the second support component 18 as well.

As was mentioned already, all of the four support elements 19 are fastened to the four first fixing devices in FIG. 6. Since the first support component 17 is formed with a height offset in relation to the second support component 18, the four support elements 19 are also arranged deeper in the arrangement according to FIG. 6. All support elements 19 are fastened analogously to the second fixing devices 22 at the second support component 18 in FIG. 7, so that the four support elements 19 are arranged as a result higher in the arrangement according to FIG. 7 than in the arrangement shown in FIG. 6. The height of the support head 25 of the support elements 19 is greater than the difference in depth between the first and second support components, so that the pressurized gas cylinder 9 does not lie on the second support component 18 in the arrangement of a pressurized gas cylinder 9 on the holding part 15 in FIG. 6, either, i.e., it lies exclusively on the support components 19 without taking into account the contact with the tightening strap, not shown.

Figure 7:
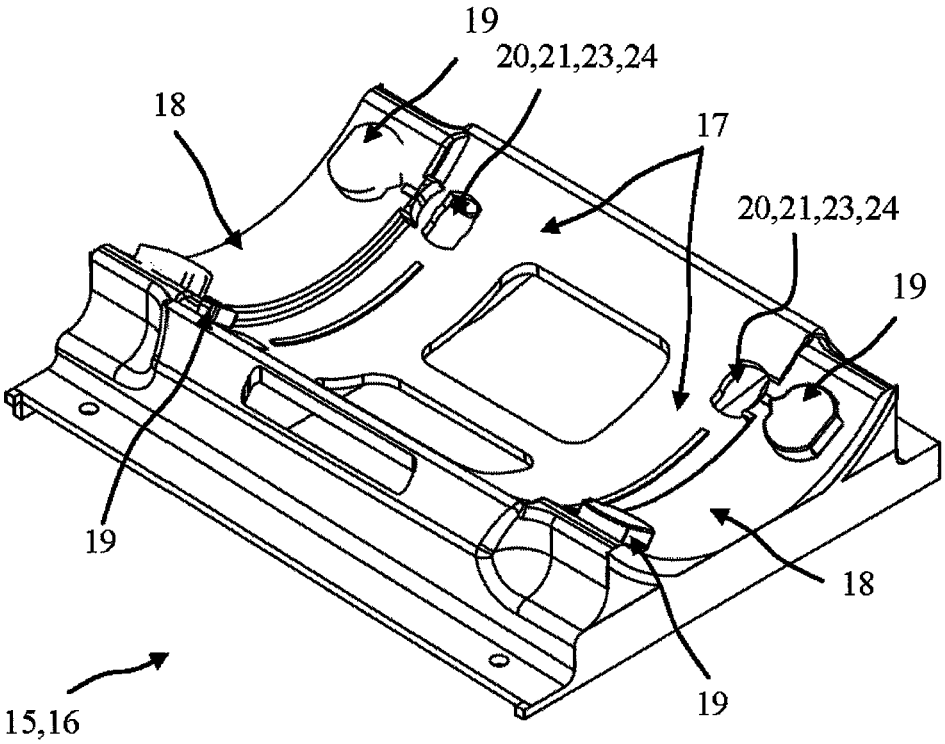
FIG. 7 is a perspective view of the holding part according to FIG. 3 with support elements in a second support position at second fixing devices.
Figure 8:
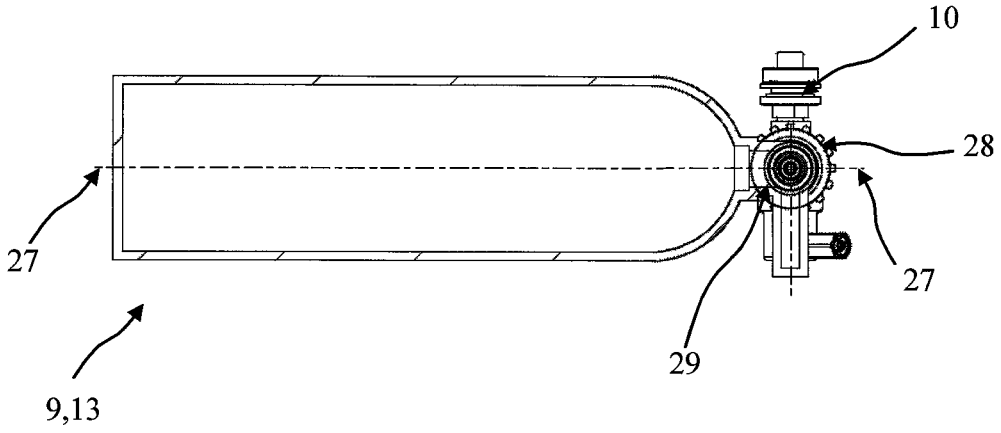
FIG. 8 is a longitudinal sectional view of a pressurized gas cylinder connected with a pressure reducer.

To fasten a steel cylinder with an external diameter of 100 mm with a smaller diameter, the four support elements 19 are thus to be fastened to the second fixing devices 22 according to the arrangement shown in FIG. 7, and all four support elements 19 at the first fixing devices 21 are to be fastened for fastening a pressurized gas cylinder 9 with a larger diameter, e.g., a cylinder made of CFC with an external diameter of 110 mm. When fastening pressurized gas cylinders 9 with a different external diameter, these cylinders thus have an identical centric longitudinal axis 27. The pressurized gas cylinder 9 is connected by means of a 90° pressurized gas elbow 29 and a handwheel 28 to the pressure reducer 10 formed permanently and unchangeably at the respirator 12. Pressure reducer 10 is fastened with a pressure reducer fastening part 30 to the carrying tray 11 of the respirator 12. The position of the connecting branch of the pressure reducer 10 in relation to the rest of the respirator 12, especially the holding part 15, is thus unchangeable. The height offset between the first and second support components 17, 18 in its radial distance from the longitudinal axis 27 corresponds here to the difference between the external radius of the larger CFC cylinder and the smaller pressurized gas cylinder made of steel, i.e., 2.5 mm or half the difference of the different external diameters of 110 mm and 100 mm of the CFC pressurized gas cylinder 9 and the steel pressurized gas cylinder 9. As a result, the pressurized gas cylinders 9 with a different external diameter can be fastened with an identical centric longitudinal axis 27 to the respirator 12 or to the pressurized gas cylinder holder 14, and the compressed air ports, e.g., the 90° pressurized gas elbow 29, have a constant alignment to the pressure reducer 10 in case of a different external diameter of the pressurized gas cylinders 9 as well.

On the whole, essential advantages are associated with the respirator 12 according to the present invention and with the pressurized gas cylinder holder 14 according to the present invention. Holding part 14 can be manufactured in a simple manner by means of injection molding from a thermoplastic. To fasten different pressurized gas cylinders 9 with a different external diameter, the support elements 19 can be fastened manually in a simple manner in the first or second fixing devices 21, 22. Based on the fact that the support elements 19 are made of rubber, these can be easily removed from the fixing devices 20 and fastened again at other fixing devices 20. Pressurized gas cylinders with a different external diameter can thus be fastened in a simple manner to the pressurized gas cylinder holder 14 with an identical centric longitudinal axis 27 without a separate tool.

While specific embodiments of the invention have been shown and described in detail to illustrate the application of the principles of the invention, it will be understood that the invention may be embodied otherwise without departing from such principles.

| LIST OF REFERENCE NUMBERS | |
|---|---|
| 1 | Breathing mask |
| 2 | Expiration tube |
| 3 | $CO_2$ absorber |
| 4 | Breathing bag |
| 5 | Breathing air cooler |
| 6 | Inspiration tube |
| 7 | Directional valve |
| 8 | Port of breathing mask |
| 9 | Pressurized gas cylinder |

-continued

| LIST OF REFERENCE NUMBERS | |
|---|---|
| 10 | Pressure reducer |
| 11 | Carrying tray |
| 12 | Respirator |
| 13 | Oxygen cylinder |
| 14 | Pressurized gas cylinder holder |
| 15 | Holding part |
| 16 | Holding frame |
| 17 | First support component with greater radius of curvature |
| 18 | Second support component with smaller radius of curvature |
| 19 | Support element |
| 20 | Fixing device |
| 21 | First fixing devices for larger pressurized gas cylinder |
| 22 | Second fixing devices for smaller pressurized gas cylinder |
| 23 | Recess |
| 24 | Opening |
| 25 | Support head |
| 26 | Locking pipe |
| 27 | Longitudinal axis |
| 28 | Handwheel |
| 29 | 90° pressurized gas elbow |
| 30 | Pressure reducer fastening part |

What is claimed is:

1. A pressurized gas cylinder holder for a respirator, the pressurized gas cylinder holder comprising:

a pressurized gas cylinder holding part;

a tightening strap for fastening a pressurized gas cylinder to the holding part; and a plurality of support elements, each of the plurality of support elements being provided as a separate component, the holding part comprising four fixing devices, each of the fixing devices for fixing one of the plurality of support elements to provide a first support element position, relative to the holding part, for providing a first support position for pressurized gas cylinders with a first external diameter and to provide a second support element position, relative to the holding part, for providing a second support position for pressurized gas cylinders with a second external diameter, the first support position and the second support position defining a common centric longitudinal axis, the holding part comprising a first support component defining a first support radius and a second support component defining a second support radius, the first component and the second component having an arc-segment shaped cross section, the first support radius having a greater radius of curvature than at the second support radius, the first support component being aligned essentially concentrically with the second support component.

2. A pressurized gas cylinder holder in accordance with claim 1, wherein:

the fixing devices comprise a recess or as hook and loop fastener at the holding part;

the support elements are fastened with the fixing devices whereby upon tightening the tightening strap on the pressurized gas cylinder, which lies on the support elements, the support elements cannot be moved.

3. A pressurized gas cylinder holder in accordance claim 1, wherein the support elements cooperate with the fixing devices for fastening the support elements to the holding part in a positive-locking or non-positive manner.

4. A pressurized gas cylinder holder in accordance claim 1, wherein the holding part comprises eight fixing devices and the plurality of support elements comprise four support elements.

5. A pressurized gas cylinder holder in accordance claim 1, wherein:

the fixing devices comprise first fixing devices and second fixing devices;

the holding part comprises a first support component with the first fixing devices and a second support component with the second fixing devices;

the support elements connected to the first fixing devices have a first radial distance from the centric longitudinal axis;

the support elements connected to the second fixing devices have a second radial distance from the centric longitudinal axis;

the first radial distance is greater than the second radial distance.

6. A pressurized gas cylinder holder in accordance claim 1, wherein at least one of:

the holding part is formed of a thermoplastic;

the holding part is formed of a single piece;

the support elements are formed of plastic;

the support elements are formed of an elastic plastic;

the support elements are formed of rubber; and the pressurized gas cylinder holding part includes a fixing device for fixing the tightening strap in one of different positions.

7. A pressurized gas cylinder holder in accordance with claim 1, wherein the first support component comprises a first support component surface, a first support component first end and a first support component second end, the first support component surface being located at a first support component surface radial position, the first support component surface extending between the first support component first end and the first support component second end in one circumferential direction of the first support component, wherein a first support component opening is defined between the first support component first end and the first component second end in another circumferential direction of the first support component, the first support component comprising one or more of the four fixing devices, the second support component comprising a second support component surface, a second support component first end and a second component second end, the second support component surface extending between the second support component first end and the second support component second end in one circumferential direction of the second support component, wherein a second support component opening is defined between the second support component first end and the second support component second end in another circumferential direction of the second support component, the second support component comprising one or more of the four fixing devices, the second support component surface being located at a second support component surface radial position that is offset from the first support component surface radial position.

8. A pressurized gas cylinder holder in accordance with claim 7, wherein said second support component surface radial position is located at a height that is different than a height of the first support component surface radial position.

9. A pressurized gas cylinder holder in accordance with claim 1, wherein the second support component comprises a second support component first portion and a second support component second portion, the second component first portion being located on one axial side of the first support component with respect to a longitudinal direction of the holding part, the second component second portion being located on another axial side of the first support component with respect to the longitudinal direction of the holding part, wherein the first support component is arranged between the second support component first portion and the second support component second portion with respect to the longitudinal direction of the holding part, each of the first support component, the second support component first portion and the second support component second portion comprising one or more of the fixing devices.

10. A respirator comprising:

a pressurized gas cylinder;

a pressurized gas cylinder holder comprising:

a pressurized gas cylinder holding part;

a tightening strap for fastening a pressurized gas cylinder to the holding part; and a plurality of support elements, each of the plurality of support elements being provided as a separate component, the holding part comprising four fixing devices for fixing the at least two support elements in a first support element position, relative to the holding part, for providing a first support position for pressurized gas cylinders with a first external diameter and in a second support element position, relative to the holding part, for providing a second support position for pressurized gas cylinders with a second external diameter, the first support position and the second support position defining a common centric longitudinal axis, the holding part comprising a first support component defining a first support radius and a second support component defining a second support radius, the first support component and the second support component having an arc-segment shaped cross section, the first support component the first support radius having a greater radius of curvature than at the second support radius, the first support component being aligned essentially concentrically with the second support component; and a pressure reducer;

a carrying tray, the pressurized gas cylinder holder being connected to the carrying tray, the pressure reducer being positioned on the tray in coordination with the centric longitudinal axis defined by the pressurized gas cylinder holder and the pressurized gas cylinder being connected to the pressurized gas cylinder holder; and a breathing mask.

11. A respirator in accordance with claim 10, further comprising at least one of:

a $CO_2$ absorber;

a breathing air cooler;

a breathing bag;

a breathing tube with an inspiration tube and an expiration tube; and an oxygen cylinder as the pressurized gas cylinder.

12. A respirator in accordance with claim 10, wherein the first support component comprises a first support component surface, a first support component first end and a first support component second end, the first support component surface being located at a first support component surface radial position, the first support component surface extending between the first support component first end and the first support component second end in one circumferential direction of the first support component, wherein a first support component opening is defined between the first support component first end and the first component second end in another circumferential direction of the first support component, the first support component comprising one or more of the four fixing devices, the second support component comprising a second support component surface, a second support component first end and a second component second end, the second support component surface extending between the second support component first end and the second support component second end in one circumferential direction of the second support component, wherein a second support component opening is defined between the second support component first end and the second support component second end in another circumferential direction of the second support component, the second support component comprising one or more of the four fixing devices, the second support component surface being located at a second support component surface radial position that is offset from the first support component surface radial position.

13. A respirator in accordance with claim 12, wherein said second support component surface radial position is located at a height that is different than a height of the first support component surface radial position.

14. A respirator in accordance with claim 10, wherein the second support component comprises a second support component first portion and a second support component second portion, the second component first portion being located on one axial side of the first support component with respect to a longitudinal direction of the holding part, the second component second portion being located on another axial side of the first support component with respect to the longitudinal direction of the holding part, wherein the first support component is arranged between the second support component first portion and the second support component second portion with respect to the longitudinal direction of the holding part, each of the first support component, the second support component first portion and the second support component second portion comprising one or more of the fixing devices.

15. A method for fastening a pressurized gas cylinder to a pressurized gas cylinder holder comprising a pressurized gas cylinder holding part, a tightening strap for fastening a pressurized gas cylinder to the holding part, and a plurality of support elements, each provided as a separate component, the holding part comprising four fixing devices for fixing the at least two support elements in a first support element position, relative to the holding part, for providing a first support position for pressurized gas cylinders with a first external diameter and in a second support element position, relative to the holding part, for providing a second support position for pressurized gas cylinders with a second external diameter, the first support position and the second support position defining a common centric longitudinal axis, the method comprising the steps of:

fastening the support elements to selected fixing devices of the fixing devices such that the support elements are at selected positions at the holding part adapted to one of different external diameters of the pressurized gas cylinder to provide one of the first support position and the second support position;

placing a pressurized gas cylinder on the holding part of the pressurized gas cylinder holder, wherein the pressurized gas cylinder is placed on the support elements at the holding part of the pressurized gas cylinder holder, the holding part comprising a first support component defining a first support radius and a second support component defining a second support radius, the first support component and the second support component having an arc-segment shaped cross section, the first support radius having a greater radius of curvature than at the second support radius, the first support component being aligned essentially concentrically with the second support component;

placing the tightening strap on the pressurized gas cylinder; and tightening and fastening the at least one tightening strap, so that the pressurized gas cylinder is fastened between the tightening strap and the holding part.

16. A method in accordance with claim 15, wherein at least one of:

the pressurized gas cylinders are placed on the holding part exclusively on the support elements and are in contact with the support elements after the tightening of the tightening strap;

the support elements are fastened to the holding part at a greater distance from the centric longitudinal axis of the pressurized gas cylinder in case of a pressurized gas cylinder with a larger external diameter than in case of pressurized gas cylinders with a smaller external diameter; and the difference in the distance of the support elements for the larger pressurized gas cylinder and the smaller pressurized gas cylinder from the centric longitudinal axis essentially corresponds to half the difference between the external diameter of the larger pressurized gas cylinder and the external diameter of the smaller pressurized gas cylinder.

17. A method in accordance with claim 15, wherein the support elements cooperate with the fixing devices for fastening the support elements to the holding part in a positive-locking or non-positive manner.

18. A method in accordance with claim 15, wherein the first support component comprises a first support component surface, a first support component first end and a first support component second end, the first support component surface being located at a first support component surface radial position, the first support component surface extending between the first support component first end and the first support component second end in one circumferential direction of the first support component, wherein a first support component opening is defined between the first support component first end and the first component second end in another circumferential direction of the first support component, the first support component comprising one or more of the four fixing devices, the second support component comprising a second support component surface, a second support component first end and a second component second end, the second support component surface extending between the second support component first end and the second support component second end in one circumferential direction of the second support component, wherein a second support component opening is defined between the second support component first end and the second support component second end in another circumferential direction of the second support component, the second support component comprising one or more of the four fixing devices, the second support component surface being located at a second support component surface radial position that is offset from the first support component surface radial position.

19. A method in accordance with claim 18, wherein said second support component surface radial position is located at a height that is different than a height of the first support component surface radial position.

20. A method in accordance with claim 15, wherein the second support component comprises a second support component first portion and a second support component second portion, the second component first portion being located on one axial side of the first support component with respect to a longitudinal direction of the holding part, the second component second portion being located on another axial side of the first support component with respect to the longitudinal direction of the holding part, wherein the first support component is arranged between the second support component first portion and the second support component second portion with respect to the longitudinal direction of the holding part, each of the first support component, the second support component first portion and the second support component second portion comprising one or more of the fixing devices.

* * * * *